US007455187B2

(12) United States Patent
Toudou et al.

(10) Patent No.: US 7,455,187 B2
(45) Date of Patent: Nov. 25, 2008

(54) TRAVELING CRANE AND ASSEMBLING/DISASSEMBLING METHOD THEREOF

(75) Inventors: Osamu Toudou, Akashi (JP); Koichi Shimomura, Akashi (JP); Keisuke Fukumoto, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 0 days.

(21) Appl. No.: 11/937,788

(22) Filed: Nov. 9, 2007

(65) Prior Publication Data

US 2008/0073305 A1 Mar. 27, 2008

Related U.S. Application Data

(62) Division of application No. 11/022,780, filed on Dec. 28, 2004, now Pat. No. 7,341,158.

(30) Foreign Application Priority Data

Jan. 9, 2004 (JP) ..... 2004-004389
Jan. 19, 2004 (JP) ..... 2004-010986

(51) Int. Cl.
*B66C 23/82* (2006.01)

(52) U.S. Cl. ..... 212/262; 212/239; 212/300

(58) Field of Classification Search ..... 212/262, 212/239, 300
See application file for complete search history.

(56) References Cited

U.S. PATENT DOCUMENTS 3,037,641 A 6/1962 Potter et al.
3,176,854 A 4/1965 Brown
3,306,470 A 2/1967 Green et al.
4,491,228 A 1/1985 Poock et al.
7,216,774 B2 5/2007 Mizuta et al.
7,311,213 B2 12/2007 Mizuta et al.
2005/0192732 A1 9/2005 Narisawa et al.

FOREIGN PATENT DOCUMENTS

JP 7-257878 10/1995
JP 9-278369 10/1997
JP 11-11874 1/1999
JP 11-292471 10/1999
WO 03/084855 10/2003

*Primary Examiner*—Thomas J. Brahan
(74) *Attorney, Agent, or Firm*—Oblon, Spivak, McClelland, Maier & Neustadt, P.C.

(57) ABSTRACT

A traveling crane according to the present invention includes a hook hoisting guide sheave for guiding a hook hoisting rope from the top of a boom toward the end of a jib, and the hook hoisting guide sheave is arranged on the top of the boom in a state that the guide sheave can guide the hook hoisting rope along the upper surface of the boom by folding the rope toward an upper spreader placed at a position adjacent to a boom anchor during assembling/disassembling of the crane. Thereby, the upper spreader can be moved between the boom anchor and a far end of the boom without providing a guide sheave dedicated for moving the upper spreader. Pairs of support legs are downward provided on both sides and in front and in rear of the upper spreader and a roller is provided for each support leg, so that interference between the upper spreader during movement and obstacles on the boom upper surface can be prevented even in a horizontal movement system excellent in operating efficiency.

11 Claims, 12 Drawing Sheets

TRAVELING CRANE AND ASSEMBLING/DISASSEMBLING METHOD THEREOF

This application is a division of U.S. patent application Ser. No. 11/022,780 filed on Dec. 28, 2004, the entire contents of which are incorporated herein by reference. This application is based upon and claims the benefit of priority from prior Japanese Patent Application Nos. 2004-004389, filed Jan. 09, 2004 and 2004-010986, filed on Jan. 19, 2004.

BACKGROUND OF THE INVENTION

1. Field of the Invention

The present invention relates to a traveling crane having a jib derrickably attached at an end of a boom and an assembling method thereof.

2. Description of the Related Art

For transportation to a work site, a large scale traveling crane is divided into a crane body, attachments, such as a boom and a jib, and components of derricking (raising and lowering) devices for the attachments, so that these divisions are assembled on the work site.

Among lower and upper spreaders around which a jib derricking rope is routed, the upper spreader is necessary to be drawn and to be pulled back during disassembling; since the upper spreader is heavy to be moved by man power, the drawing and pulling back during disassembling of the upper spreader are performed using a hoisting force of a winch.

For example, a technique disclosed in Japanese Unexamined Patent Application Publication No. 11-292471 using a hook-hoisting (a hook winding-up) winch as an auxiliary winch has been known.

This method is that a pulling rope drawn from a auxiliary winch dedicated for assembling/disassembling is fixed to an upper spreader, and by rewinding a jib derricking rope while winding this pulling rope, the upper spreader is moved along an upper boom surface horizontally from a boom anchor (one end of the boom close to the crane body as a base machine) toward a far end of the boom (the other end of the boom connected to the jib).

In this method, there has been a problem that a dedicated guide sheave for assembling/disassembling must be provided at an end of a rear member constituting a strut for moving the upper spreader, so that the weight in the vicinity of the boom end (around the strut) becomes larger, having disadvantages in operating efficiency and in cost overrunning due to the additional sheave.

On the other hand, when the jib derricking rope is rewound (being wound during disassembling) while the hook-hoisting rope is wound (being rewound during disassembling), since the synchronization of both the ropes depends on manual operation of an operator, there have been problems due to asynchrony that both the ropes may tear off or a physical facility may break due to excessive tension thereof, or in contrast irregular winding is caused by excessively small tension of the rope.

In addition, in the technique of the Publication, the asynchrony may be absorbed by the rotational displacement of the strut; however, this only is insufficient for maintaining the proper rope tension because the rotational displacement of the strut is limited by a backstop. Also, in this technique, the upper spreader is floated and moved toward the end of the boom, and then, the spreader is descended along the upper surface of the boom by rewinding the hook-hoisting rope so as to connect the spreader to a guyline of the strut. During disassembling, the upper spreader is moved toward the boom anchor through the reverse procedure thereto.

However, in this method, when the upper spreader is moved along the boom upper surface horizontally, the spreader may interfere with members located on the boom upper surface, such as ropes and piping (referred to obstacles below), so that not only the movement of the spreader is hindered but also both components may be damaged.

On the other hand, in the floating system floating the upper spreader in the air, although this interference can be avoided, since the heavy upper spreader with a weight of 300 kg or more has to be floated and moved, the winch must be carefully operated, so that operating efficiency is reduced lower than in the horizontal movement system.

SUMMARY OF THE INVENTION

Accordingly, it is a first object of the present invention to provide a traveling crane capable of moving an upper spreader between a boom anchor and a boom far end with a hook-hoisting rope and a jib derricking rope without providing a guide sheave dedicated for moving the upper spreader, and its assembling/disassembling method.

It is a second object of the present invention to provide a traveling crane capable of preventing the interference of the upper spreader during movement with obstacles located on the boom upper surface even a horizontal movement system is adopted, which is safety and efficient in operation.

A traveling crane according to the present invention has a fundamental structure as follows.

That is, a traveling crane according to the present invention includes a base machine having a boom derrickably attached thereto at one end of the boom and a jib derrickably attached to the other end of the boom; a jib derricking device for raising and lowering the jib; and a hook hoisting device for hanging up and down a lifting hook from the end of the jib. This jib derricking device includes a jib derricking winch mounted on the base machine; a jib derricking rope wound/rewound by the jib derricking winch; lower and upper spreaders around which the jib derricking rope is routed for raising and lowering the jib; a strut attached to the top of the boom rotatably about a horizontal axis in a fore-and-aft direction; a jib guyline connecting the strut to the jib; and a strut guyline connecting the strut to the upper spreader. Furthermore, the hook hoisting device includes a hook hoisting winch mounted on the base machine; a hook hoisting rope wound/rewound by the hook hoisting winch; and a hook hoisting guide sheave for guiding the hook hoisting rope from the top of the boom toward the end of the jib, and in which the hook hoisting guide sheave is arranged on the top of the boom in a state that the guide sheave can guide the hook hoisting rope along the upper surface of the boom by folding back the rope toward the upper spreader placed at a position adjacent to a boom anchor during assembling/disassembling of the traveling crane.

An assembling/disassembling method of a traveling crane according to the present invention has a fundamental procedure as follows.

That is, in an assembling/disassembling method of a traveling crane according to the present invention, the traveling crane includes a base machine having a boom derrickably attached thereto at one end of the boom and a jib derrickably attached to the other end of the boom, and the traveling crane satisfies requirements A and B as follows:

A. a jib derricking device for raising and lowering the jib includes a jib derricking winch mounted on the base machine; a jib derricking rope wound/rewound by the jib derricking winch; lower and upper spreaders around which the jib derricking rope is routed for raising and lowering the jib; a strut attached to the top of the boom rotatably about a horizontal axis in a fore-and-aft direction; a jib guyline connecting the strut to the jib; and a strut guyline connecting the strut to the upper spreader, in which during assembling/disassembling of the crane, the upper spreader is arranged movably along the upper surface of the boom from the boom anchor toward a far end of the boom; and B. a hook hoisting device for hanging up and down a lifting hook from the end of the jib includes a hook hoisting winch mounted on the base machine; a hook hoisting rope wound/rewound by the hook hoisting winch; and a hook hoisting guide sheave for guiding the hook hoisting rope from the top of the boom toward the end of the jib, and the assembling/disassembling method of a traveling crane according to the present invention includes the steps (i) to (v):

(i) during assembling of the crane, in a state that the boom is lowered onto the ground, the jib derricking rope being routed between the lower and upper spreaders in multiple-stages;

(ii) the hook hoisting rope drawn from the hook hoisting winch being routed around the hook hoisting guide sheave so as to fix the terminal thereof to the upper spreader;

(iii) while the hook hoisting rope being wound by the hook hoisting winch, the upper spreader being moved along the upper surface of the boom toward the far end of the boom by rewinding the jib derricking rope with the jib derricking winch;

(iv) the upper spreader being separated from the hook hoisting rope and being connected to the strut guyline; and (v) on the other hand, during disassembling of the crane, the upper spreader being separated from the strut guyline, and while the hook hoisting rope being rewound by the hook hoisting winch in a state that the hook hoisting rope is connected to the upper spreader, the upper spreader being moved on the upper surface of the boom adjacent to the boom anchor by winding the jib derricking rope with the jib derricking winch.

According to the present invention, since the hook hoisting guide sheave originally provided at the boom top as part of the hook hoisting device is also used as a guide sheave for leading the hook hoisting rope to the upper spreader during assembling/disassembling of the crane, it is not necessary to separately provide a guide sheave for moving the upper spreader, and the upper spreader may be moved between the boom anchor and the far end of the boom with the hook hoisting rope and the jib derricking rope.

Hence, owing to no increase in weight of the vicinity of the boom end (around the strut), the operation capacity is advantageously increased as well as cost is reduced.

A traveling crane according to the present invention has a fundamental structure as follows.

That is, a traveling crane according to the present invention includes a base machine having a boom derrickably attached thereto at one end of the boom and a jib derrickably attached to the other end of the boom; and a jib derricking device for raising and lowering the jib. The jib derricking device includes a jib derricking winch for derricking the jib; a jib derricking rope wound/rewound by the jib derricking winch; lower and upper spreaders around which the jib derricking rope is routed for raising and lowering the jib; a strut attached to the top of the boom rotatably about a horizontal axis in a fore-and-aft direction; a jib guyline connecting the strut to the jib; and a strut guyline connecting the strut to the upper spreader, in which during assembling/disassembling of the crane, the upper spreader is constructed movably along the upper surface of the boom between a position adjacent to a boom anchor and a position, at which the strut guyline is fixed or separated, adjacent to a far end of the boom. Furthermore, the upper spreader is provided with support legs arranged to downward protrude for upward supporting the spreader on the upper surface of the boom while support leg guide members are arranged on the upper surface of the boom for guiding the support legs.

According to the present invention, since the upper spreader is horizontally moved in a floated state from the boom upper surface with the support legs and the support leg guide members, the interference between the upper spreader and obstacles on the boom upper surface does not occur during spreader movement.

In this case, the support legs and the support leg guide members may be partially provided in the spreader and on the boom upper surface, as well as at positions capable of avoiding obstacles, so that the interference between the obstacles and the support legs can be readily avoided.

Hence, the interference problem to the obstacles can be solved during spreader movement so that the spreader can be smoothly moved from the boom anchor toward the far end of the boom while damages of the spreader and the obstacles due to the interference can be prevented.

BRIEF DESCRIPTION OF THE DRAWINGS

FIG. 6A is a partially enlarged view of the state of FIG. 5, and FIG. 6B is a partially enlarged view of a state that the upper spreader and a strut guyline are connected together;

FIG. 15A is a partially enlarged view of the state of FIG. 5, and FIG. 15B is a partially enlarged view of a state that the upper spreader and the strut guyline are connected together.

DESCRIPTION OF THE PREFERRED EMBODIMENTS

Embodiments according to the present invention will be described below with reference to the drawings.

First Embodiment

See FIGS. 1 to 9

Figure 1:
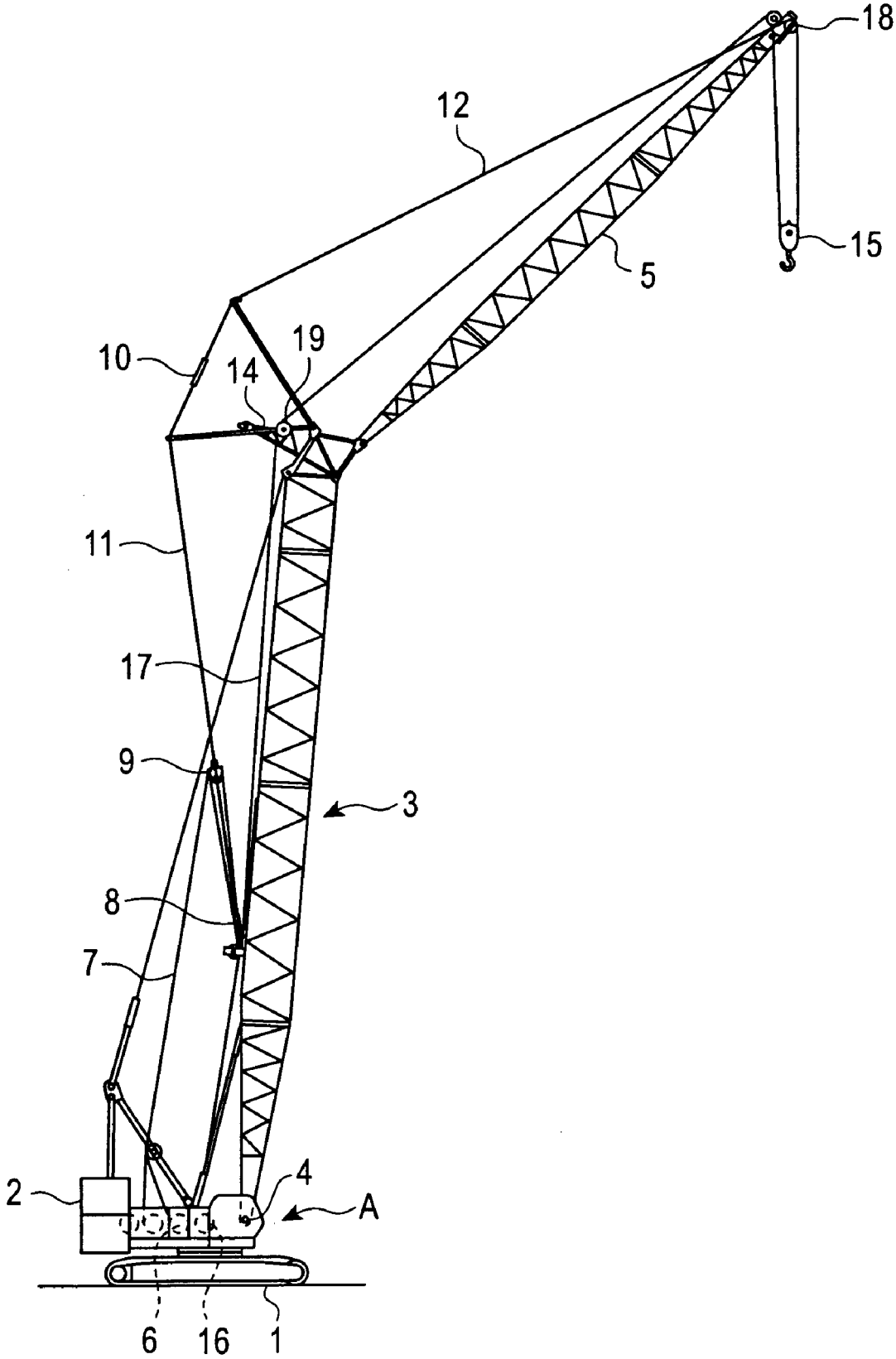
FIG. 1 is a schematic side view of a traveling crane according to a first embodiment of the present invention during crane operation.

FIG. 1 shows an operation state (assembled state) of a traveling crane according to the present invention; FIGS. 2 to 7 show the procedure of assembling/disassembling of the crane.

In the drawings, on a crawler lower traveling body 1, an upper rotating body 2 is revolvably mounted so as to constitute a base machine A therewith. On the upper rotating body 2, a boom (may also be called as a tower depending on a specification) 3 is derrickably mounted so as to be raised and lowered with a boom foot bin 4 as a derricking fulcrum. At a far end of the boom 3, a jib 5 is derrickably attached.

In addition, there may be a crane that is operated by derricking both the boom 3 and the jib 5; the present invention may incorporate a traveling crane of this type.

Fundamentally, in a state that the boom 3 is maintained at a predetermined angle, the crane is operated by derricking the jib 5 (in a luffing crane, the boom 3 is also derricked).

A jib derricking device for derricking the jib 5 includes a jib derricking winch 6 mounted on the upper rotating body 2 of the base machine A, a jib derricking rope 7 wound/unwound by the jib derricking winch 6, lower and upper spreaders 8 and 9 around which the jib derricking rope 7 is routed, and a strut 10 attached to the boom top rotatably about a horizontal axis in a fore-and-aft direction. The upper spreader 9 and the strut 10 are connected together with a strut guyline 11 while the strut 10 and the jib end are connected together with a jib guyline 12.

Before assembling, the upper spreader 9 is placed on the upper surface of a position adjacent to the boom anchor because the routing of the jib derricking rope 7 is facilitated by reducing the distance to the lower spreader 8 fixed to a position adjacent to the boom anchor, and during the assembling, the jib derricking rope 7 is drawn to a position adjacent to the far end of the boom, i.e., a position capable of connecting to the strut guyline 11.

The strut 10 receives an angular moment due to the strut self-weight in the fore-and-aft direction, a forward overturning moment due to the self-weight of the jib 5, and a backward overturning moment due to the winding force of the jib derricking rope 7. During operation, the strut 10 supports the jib 5 by the forward overturning moment due to the self-weight of the jib 5 and the bearing power of the jib derricking rope 7 against the moment while rotating in the fore-and-aft direction in accordance with the derricking of the jib 5.

The jib derricking rope 7 is routed around sheaves of the lower and upper spreaders 8 and 9 in multiple-stages. The terminal of the rope 7 is fixed to the lower spreader 8 through a load cell 13 (see FIG. 3), which is tension detecting means for detecting the tension of the rope 7.

A strut mast 14 with a sheave is also provided at the boom top for maintaining the strut guyline 11 at an upper position of the boom 3 during assembling/disassembling of the crane.

On the other hand, a hook hoisting device for winding/unwinding operation by hanging a lifting hook 15 from the top of the jib 5 includes a hook hoisting winch 16 mounted on the upper rotating body 2 of the base machine A and a hook hoisting rope 17 wound/unwound by the hook hoisting winch 16. The hook hoisting rope 17 is stretched around between the lifting hook 15 and a jib end sheave 18 so as to fix the lifting hook 15 to the jib end movably in the vertical direction.

The strut mast 14 is provided with a hook hoisting guide sheave 19 disposed at a middle position in the height direction rotatably about a horizontal axis in the lateral direction. The hook hoisting rope 17 is routed to the hook hoisting guide sheave 19 from the boom anchor toward the far end of the boom.

The hook hoisting rope 17 routed to the sheave 19 is led toward the jib leading end during the crane operation shown in FIG. 1. On the other hand, during assembling/disassembling of the crane, as shown in subsequent figures to FIG. 2, the rope 17 is folded back toward the boom anchor and the leading end thereof is fixed to the upper spreader 9 (the enlarged fixed portion is shown in FIG. 3).

Figure 2:
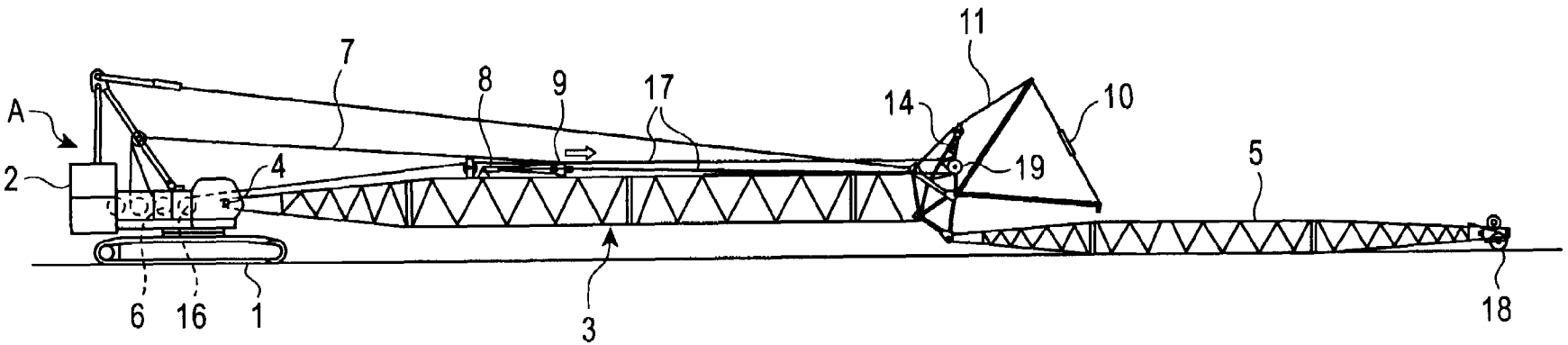
FIG. 2 is schematic side view of the crane in a middle state that an upper spreader is placed at a position adjacent to a boom anchor during assembling the crane.
Figure 3:
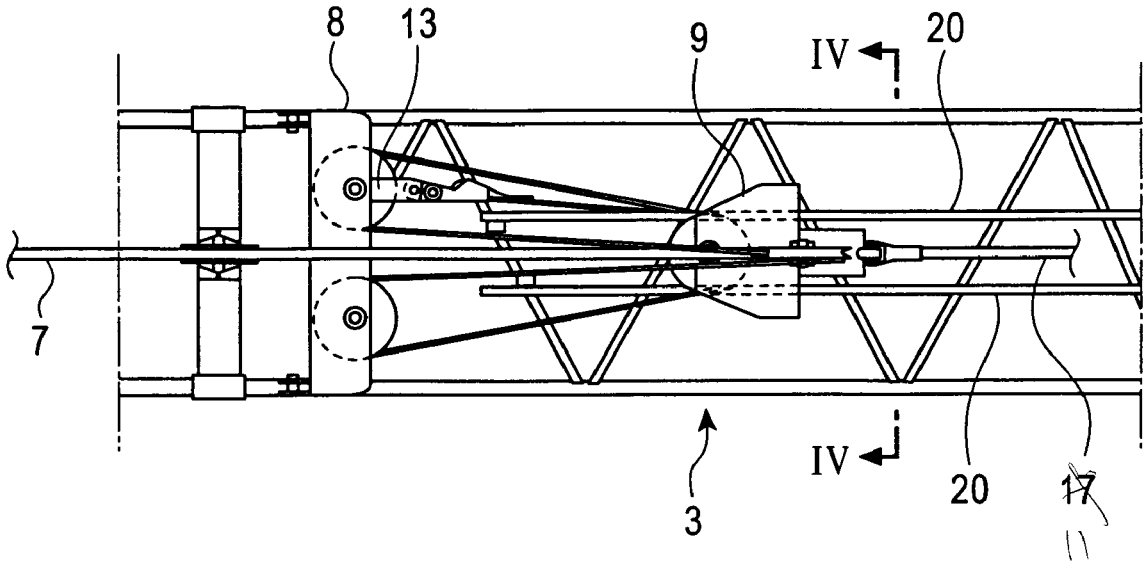
FIG. 3 is a partially enlarged plan view of the state of FIG. 2.
Figure 4:
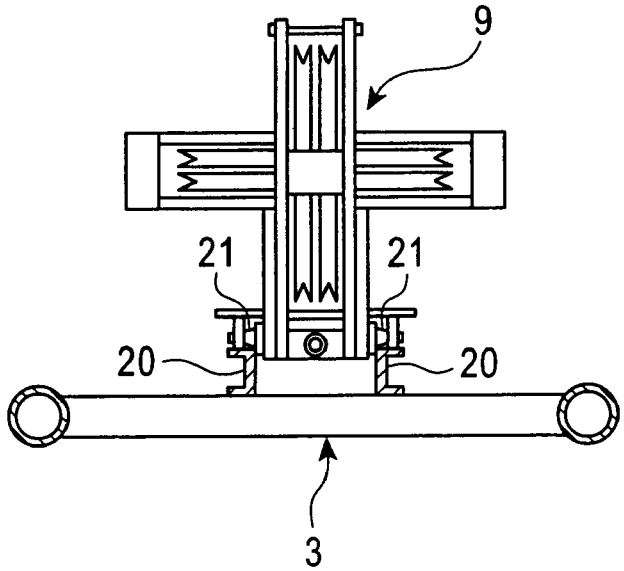
FIG. 4 is an enlarged sectional view at the line IV-IV of FIG. 3.

As shown in FIGS. 3 and 4, on the boom upper surface (the upper surface in a state when the boom 3 is lowered onto the ground as shown in FIG. 2, and up and down directions below will be in the same state), a lateral pair of rails 20 and 20 are provided along a predetermined section within between the boom anchor and the far end of the leading end thereof for placing the upper spreader 9. Furthermore, on the bottom surface of the upper spreader 9, there are provided rollers 21 and 21 rolling on the rails 20 and 20. The rails 20 and 20 and the rollers 21 and 21 constitute spreader guiding means for guiding the upper spreader 9 between the boom anchor and the leading end thereof.

By the spreader guiding means, the upper spreader 9 can be smoothly moved along the boom upper surface while the boom 3 and the upper spreader 9 cannot be damaged due to this spreader movement.

FIG. 3 shows a state that the upper spreader 9 for derricking the jib is placed on the upper surface of the boom 3 adjacent to the anchor before the spreader 9 is connected to the strut guyline 11. The terminal of the hook hoisting rope 17 folded back from the hook hoisting guide sheave 19, as shown in the drawing, is fixed to the upper spreader 9, and then the jib derricking rope 7 is rewound while the rope 17 being wound.

Figure 5:
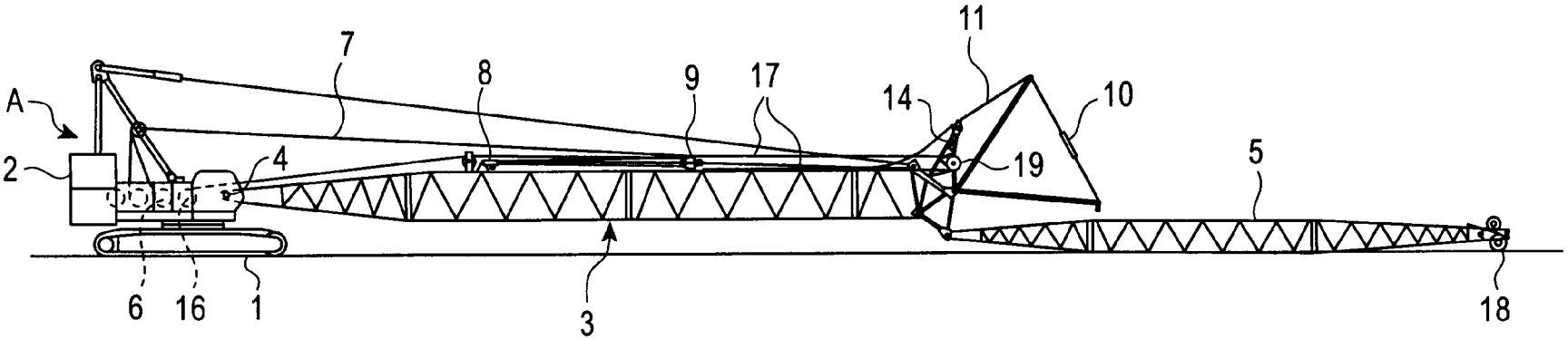
FIG. 5 is a schematic side view of a state that the upper spreader is moved toward the boom end from the state of FIG. 2.
Figure 6A:
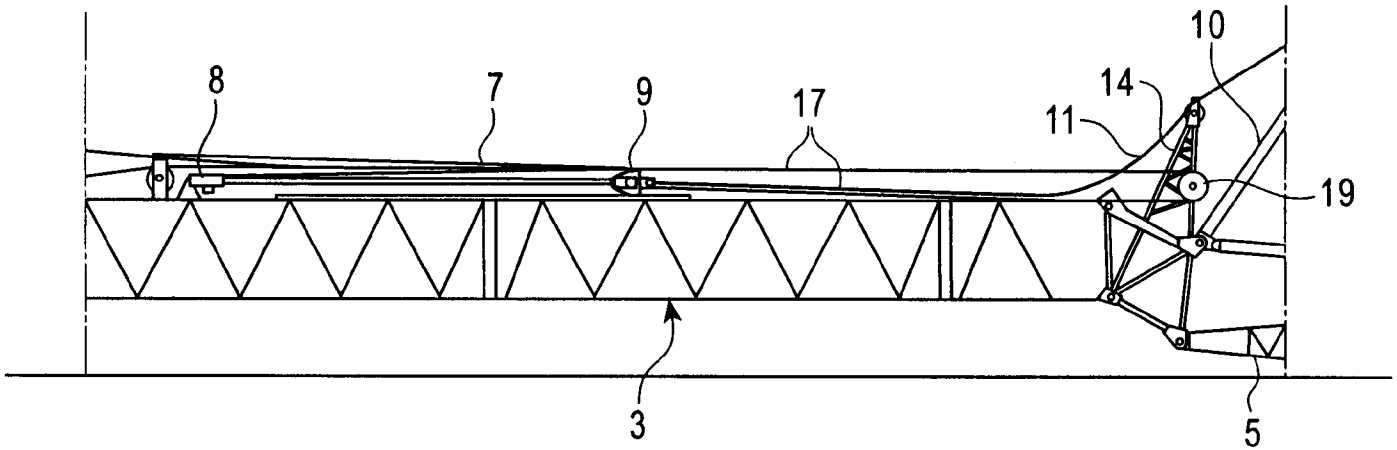
FIGS. 6A and 6B are partially enlarged views of the crane, wherein in detail

Thereby, the upper spreader 9 is moved toward the leading end of the boom 3 along the upper surface of the boom 3 while being guided by the rails 20 and 20 and the rollers 21 and 21. Then, as shown in FIGS. 5 and 6A, the upper spreader 9 is stopped to move at a position capable of connecting it to the strut guyline 11.

Figure 6B:
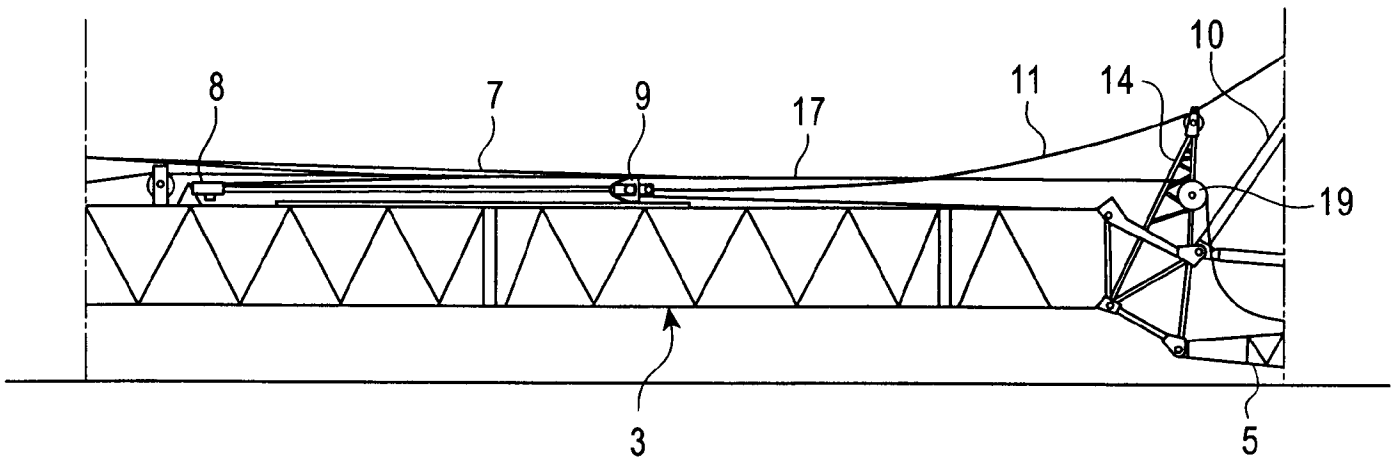
Figure 7:
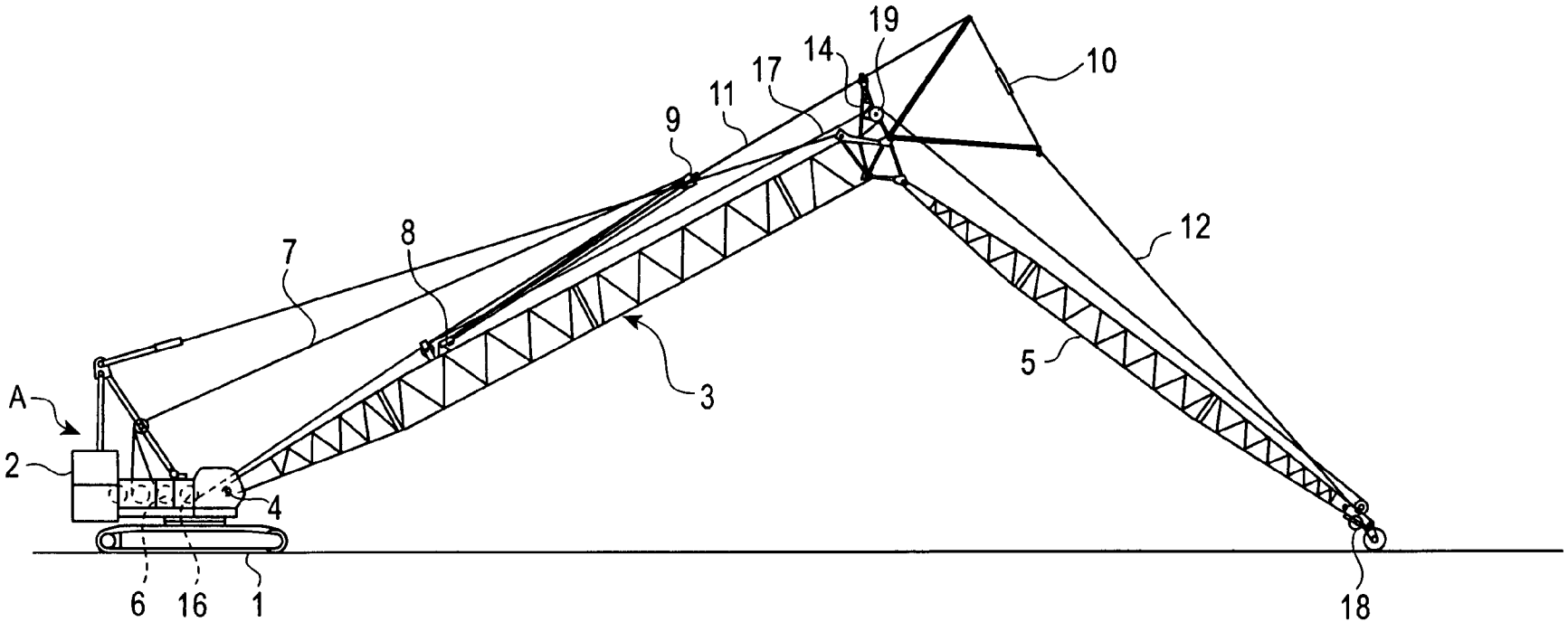
FIG. 7 is a schematic side view of a middle state that a boom and a jib are raised from the state of FIG. 6B.

Thereafter, as shown in FIG. 6B, the hook hoisting rope 17 is removed from the upper spreader 9, and the strut guyline 11 is connected thereto instead while the hook hoisting rope 17 is set to make an operational arrangement. Then, as shown in FIG. 7, the boom 3 and the jib 5 are raised so as to make the arrangement during the operation.

During the crane disassembling, the reverse operational procedure thereto is taken.

The hook hoisting guide sheave 19 originally provided at the boom top as part of the hook hoisting device is also used as a guide sheave for leading the hook hoisting rope 17 to the upper spreader 9 in such a manner. Accordingly, it is not necessary to separately provide a guide sheave at the boom top dedicated for moving the upper spreader 9 when attachments are assembled while the upper spreader 9 is moved between the boom anchor and the far end of the boom with the hook hoisting rope 17 and the jib derricking rope 7.

Owing to the rails 20 and 20 and the rollers 21 and 21, the upper spreader 9 can be smoothly moved along the boom upper surface. In addition thereto, the damage of the boom 3 or the upper spreader 9 due to the spreader movement cannot occur.

Furthermore, when the guide sheave 19 is fixed at a low position as in the embodiment, the assembling and disassembling can be safely and efficiently carried out in comparison with the above-mentioned related art in that the heavy upper spreader 9 is moved in a floated state in the air.

Figure 8:
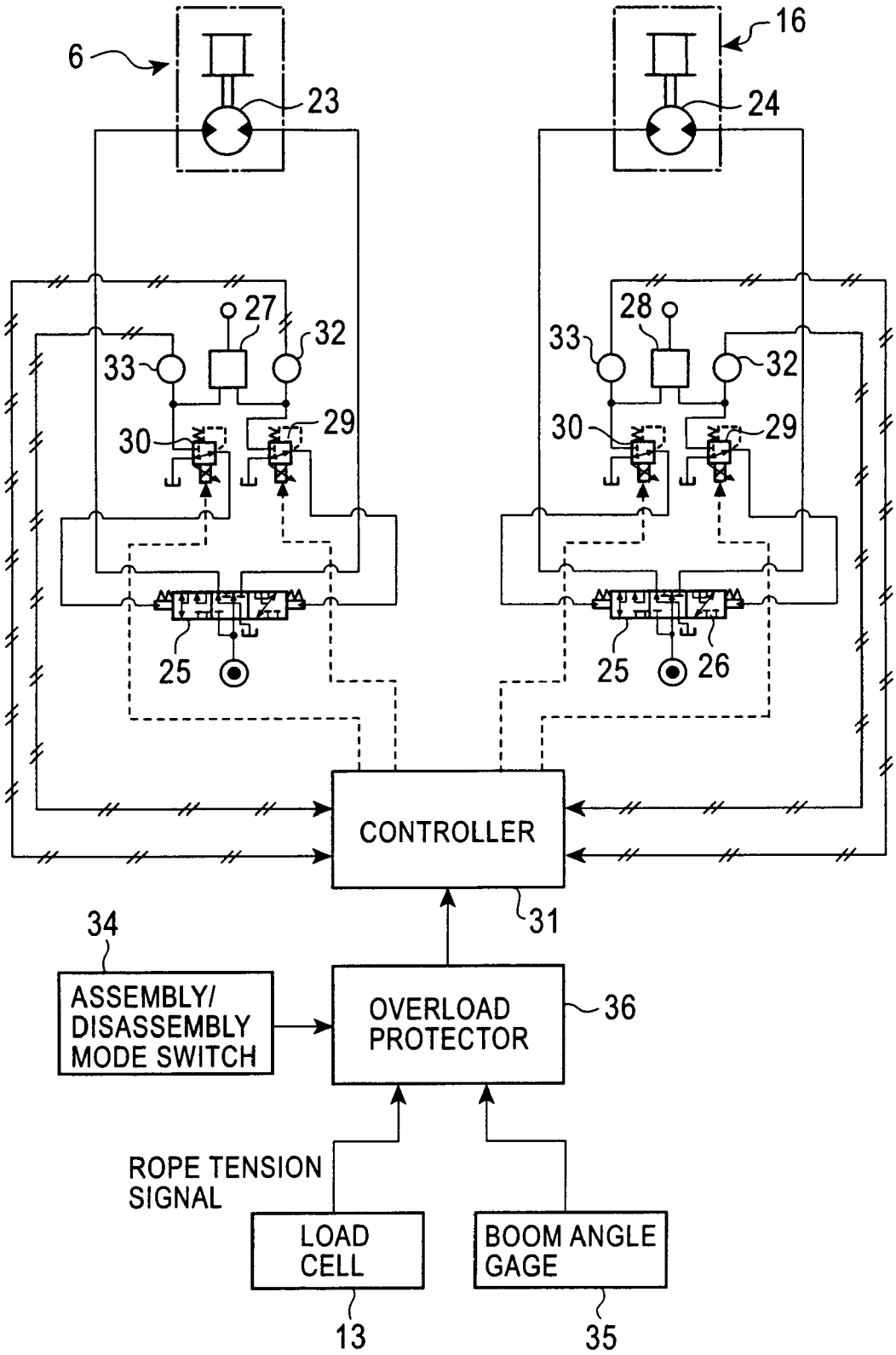
FIG. 8 is a drawing showing a motor hydraulic circuit of a jib derricking winch and a hook hoisting winch for the crane and its control system.

FIG. 8 shows a configuration of an oil hydraulic circuit and a control system for both the jib derricking winch 6 and the hook hoisting winch 16.

In the drawing, a hydraulic motor 23 (referred to as a derricking motor below) is for driving the jib derricking winch 6 while a hydraulic motor 24 (referred to as a hook hoisting motor below) is for driving the hook hoisting winch 16. Both the motors 23 and 24 are controlled by hydraulic pilot control valves 25 and 26.

Across respective pilot lines of the control valves 25 and 26, magnetic proportional valves 29 and 30 are provided for the winding side and the rewinding side. The secondary pressures (pressures corresponding to control inputs) of remote control valves 27 and 28 are controlled by the magnetic proportional valves 29 and 30, respectively.

The magnetic proportional valves 29 and 30 are controlled by signals from a controller 31 constituting controlling means. The stroke operations of the control valves 25 and 26, i.e. the operations of both the hydraulic motors 23 and 24 (winding/rewinding operations), are thereby controlled.

Into the controller 31, while remote control pressures are inputted corresponding to operations of the remote control valves 27 and 28 from pressure sensors 32 and 33, a signal from an assemble/disassemble mode switch 34 for operating during the assembling/disassembling, a tension signal from the load cell 13 for detecting the tension of the jib derricking rope 7, and a boom angular signal from a boom angle gage 35 for detecting the boom angle are entered via an overload protector 36 included in standard equipment. Thereby, during the assembling/disassembling, the winch (motor) control is performed for synchronizing both the jib derricking rope 7 and the hook hoisting rope 17 based on these inputted signals.

This action will be described with reference to the flowchart of FIG. 9.

For example, during the assembling, basically, the hook winding motor 24 is wound by operating the jib-derricking remote control valve 27 to the rewinding side and the hook-hoisting remote control valve 28 to the winding side while the jib-derricking motor 23 being rewound.

The hook hoisting rope 17 is thereby wound while the jib derricking rope 7 being rewound so that the upper spreader 9 is moved from the boom anchor toward the far end of the boom.

At this time, an operator may appropriately wind or stop the jib-derricking motor 23, or may rewind or stop the hook-hoisting motor 24 by observing tension situations of the jib derricking rope 7 and the hook hoisting rope 17.

After starting the control, it is determined: at Step S1, whether an assemble/disassemble mode is selected or not (whether the assemble/disassemble mode switch 34 is operated by an operator or not); at Step S2, whether the boom angle is smaller than the angle during the assembling/disassembling (25° or less, for example). In the case of both YES, it is determined that the crane is in the state of the assembling/disassembling (not in the normal operating state).

Since the assembling/disassembling is determined based on two conditions of the switch operation and the boom angle in such a manner, the possibility of misdetermination due to the switch-operation error like in the determination based only on the operation of the assemble/disassemble mode switch 34 is prevented.

Thereafter, synchronization control is started from subsequent Steps to Step S3.

That is, at Step S3, it is determined whether the tension of the jib derricking rope 7 is more than a predetermined first set value or not, which is established as a value smaller than a dangerous tension possibly leading to boom breakage and also close to this tension (the detected rope tension is a deceleration set value exceeding a predetermined value in the higher tension side).

In the case of YES, the winding movements, which are directed to increase the rope tension, of both the jib derricking rope 7 and the hook hoisting rope 17 are decelerated as a first step. Accordingly, at Step S4, deceleration command signals are produced from the controller 31 to the magnetic proportional valves 29 and 29 in the winding side.

Then, at Step S5, it is determined whether the rope tension is more than a predetermined second set value or not, which is established as a value possibly leading to boom breakage (the detected rope tension is a stop set value exceeding a predetermined value in the higher tension side).

In the case of YES, the winding movements, which are directed to increase the rope tension, of both the jib derricking rope 7 and the hook hoisting rope 17 are stopped as a second step. Accordingly, at Step S6, stop command signals are produced from the controller 31 to the magnetic proportional valves 29 and 29 in the winding side so as to return to Step S1.

In the case of NO at Step S1 (in the case where the assemble/disassemble mode switch 34 is not operated); in the case of NO at Step S2 (in the case where the boom angular condition during assembling/disassembling is not prepared); and in the case of NO at Step S3 (in the case where the rope tension is less than the first set value), synchronization control is assumed to be not necessary and the step is transferred to Step S7 so as to produce normal command signals to the magnetic proportional valves 29 and 29.

The normal command signals herein fundamentally mean signals of the remote control valves 27 and 28 which do not limit the secondary pressure. When the speed is controlled by external commanding means such as a trimmer, the signals include a control signal based on this external commanding means.

In the case of NO at Step S5 (in the case where the rope tension is less than the second set value), the step returns to Step S1 as it is.

By such controlling, when attachments are assembled by one's ability, the upper spreader 9 can be moved from the boom anchor toward the far end while the tensions of both the ropes 7 and 17 being maintained in a predetermined range by synchronizing both the ropes 7 and 17.

Moreover, the winding operations of both the ropes 7 and 17 are decelerated when the rope tension is increased as the first step, and if it is insufficient, the operations are stopped. Thus, in comparison with the case of abruptly stopping, the operating efficiency is improved by continuing the operations as long as the rope tension does not approach a dangerous region.

Figure 9:
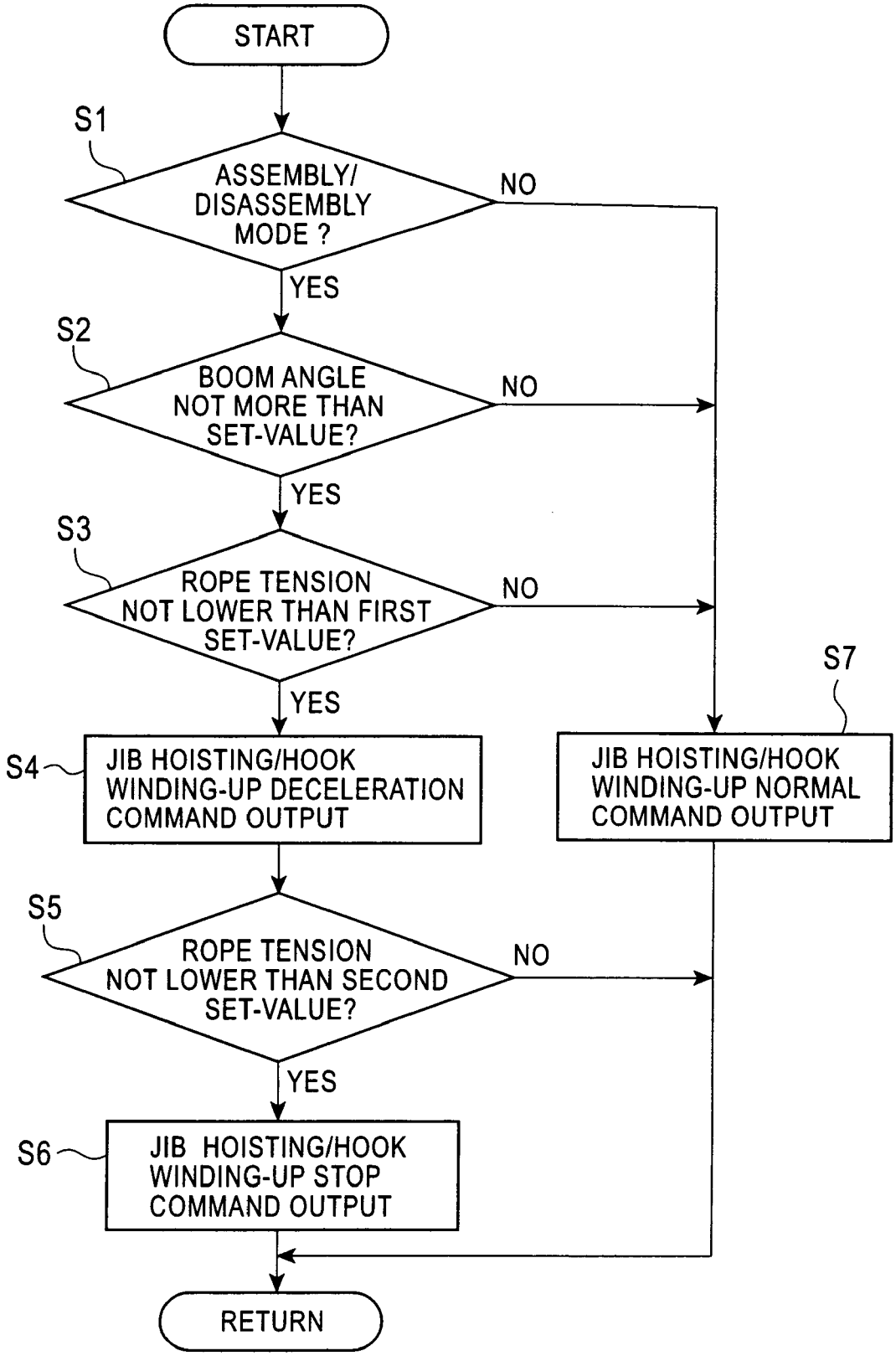
FIG. 9 is a flowchart of a control system for synchronizing both jib derricking and hook hoisting ropes during movement of the upper spreader in the crane.

In addition, in also the case where the upper spreader 9 is moved during the disassembling from the boom anchor toward the end, the control shown in the flowchart of FIG. 9 is performed on the operations of both the ropes 7 and 17. The synchronization of both the ropes 7 and 17 is thereby secured.

In such a manner, according to the present invention, a traveling crane and its assembling/disassembling method capable of precisely synchronizing a hook hoisting rope and a jib derricking rope during the movement of an upper spreader can be provided.

By the way, since there are not only a case where both the jib derricking and the hook hoisting are simultaneously operated but also a case where these actions are operated for each side, only the deceleration may also be performed without the stopping them in addition to that situations of the rope tension are facilitated to be understood by an operator by sending signals to an alarm and an alarming lamp in an operation room.

A deceleration method is desirable to decelerate the rope speed in accordance with increase in the rope tension; alternatively, stepwise deceleration with a predetermined pattern may be employed. In this case, a control signal established in the controller in advance is produced to control the deceleration.

The pattern may also be a constant slow-speed movement after gradual deceleration.

Second Embodiment

Figure 10:
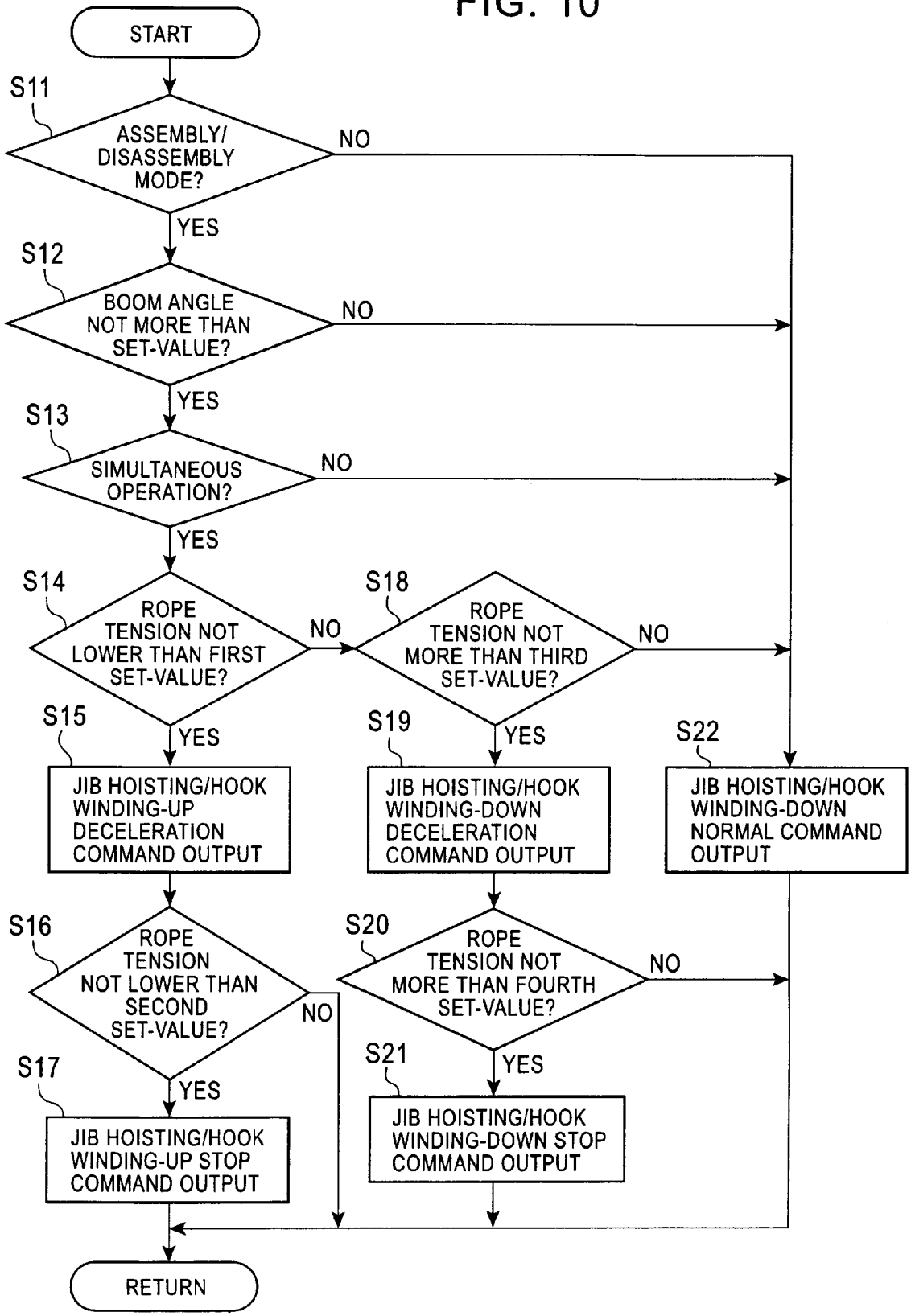
FIG. 10 is a flowchart of a control system for synchronizing both the jib derricking and hook hoisting ropes during movement of the upper spreader in a traveling crane according to a second embodiment of the present invention.
Figure 11:
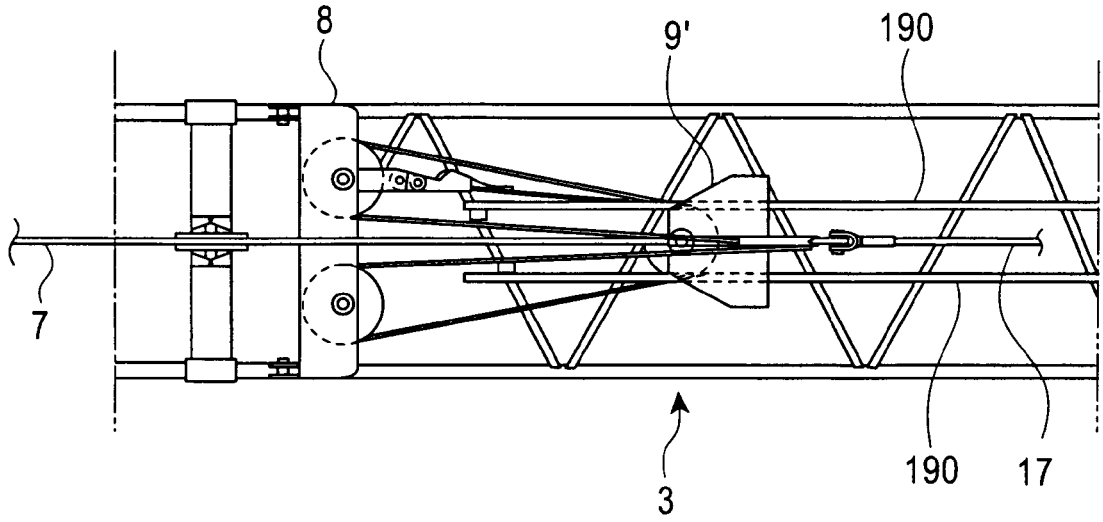
FIG. 11 is a partially enlarged plan view of a traveling crane according to a third embodiment of the present invention in a middle state that the upper spreader is placed at a position adjacent to the boom anchor during assembling the crane.

See FIG. 10

According to the first embodiment, the operation is restricted only in the direction that the tension of the jib derricking rope 7 increases. Conversely, the excessively decreased rope tension may cause the irregular winding, so that it is desirable that the operation be restricted also in the direction that the rope tension decreases.

The control according to a second embodiment having these two functions will be described with reference to FIG. 10.

It is determined: at Step S11, whether an assemble/disassemble mode is selected or not; at Step S12, whether the boom angle is the angle during the assembling/disassembling or not. Then, at Step S13, it is determined whether simultaneous operations of the rewinding of the jib derricking rope and the winding of the hook hoisting rope is carried out based on signals from the pressure sensors 32 and 33 shown in FIG. 8 or not. Thereafter, the operation in the direction that the rope tension increases is restricted (winding deceleration or stopping).

According to the second embodiment, in the case of NO at Step S14 (in the case where the rope tension is less than the first set value), at Step S18, it is determined whether the rope tension is less than a predetermined third set value or not, which is established as a value larger than a dangerous tension possibly leading to irregular winding and also close to this tension. The third set value is smaller than the first set value and is a deceleration set value with the detected rope tension less than a predetermined value in the low tension side.

In the case of YES, the rewinding operations, which are directed to further decrease the rope tension, of both the jib derricking rope 7 and the hook hoisting rope 17 are decelerated. Accordingly, at Step S19, rewinding deceleration command signals are produced from the controller 31 to the magnetic proportional valves 30 and 30 in the rewinding side.

Then, at Step S20, it is determined whether the rope tension is less than a predetermined fourth set value or not, which is established as a dangerous tension possibly leading to irregular winding. The fourth set value is smaller than the third set value and is a stop set value with the detected rope tension less than a predetermined value in the low tension side.

In the case of YES, the rewinding operations, which are directed to decrease the rope tension, of both the jib derricking rope 7 and the hook hoisting rope 17 are stopped as a second step. Accordingly, at Step S21, stop command signals are produced from the controller 31 to the magnetic proportional valves 30 and 30 in the rewinding side so as to return to Step S1.

In the case of NO at Step S11 (in the case where the assemble/disassemble mode switch 34 is not operated); in the case of NO at Step S12 (in the case where the boom angular condition during assembling/disassembling is not prepared); and in the case of NO at Step S18 (in the case where the rope tension is more than the third set value), the step is respectively transferred to Step S22 so as to produce normal command signals to the magnetic proportional valves 30 and 30 in the rewinding side, and then returns to Step S1.

In the case of NO at Step S20 (in the case where the rope tension is more than the fourth set value), the control is assumed to be not necessary so that the step returns to Step S1 as it is.

By these functions, not only the excessive tensions of both the jib derricking rope 7 and the hook hoisting rope 17 but also the irregular rope winding due to the excessively reduced rope tension can be prevented.

Also, in this case when the rope tension is reduced, the operation is decelerated as the first step, and if it is insufficient, the operation is stopped. Thus, in comparison with the case of abruptly stopping, the operating efficiency is improved.

In addition thereto, it is determined whether simultaneous operations of the rewinding of the jib derricking rope and the winding of the hook hoisting rope is carried out or not, based on signals from the pressure sensors 32 and 33. Hence, the operation can be safely controlled more securely.

(1) According to the embodiments described above, the tension of the jib derricking rope 7 is directly detected with the load cell 13 provided at the fixed point of the rope 7 to the lower spreader 8; it may also be indirectly detected with the load of the jib derricking winch 6 (the load pressure of the hydraulic motor 23).

(2) According to the embodiments described above, the windings or the rewindings of both the jib derricking rope 7 and the hook hoisting rope 17 are simultaneously decelerated or stopped; alternatively, if one of the ropes is determined to be not operated based on signals of the pressure sensors 32 and 33, only the other rope may be decelerated or stopped.

(3) According to the embodiments described above, the rails 20 and 20 and the rollers 21 and 21 are used as the spreader guiding means; instead, a slide guide plate made of a slippery material may be provided on the upper surface of the boom between the beam anchor and the beam end so as to slide the upper spreader 9 across the slide guide plate.

Third Embodiment

See FIGS. 11 to 15A

An upper spreader 9' structured differently from that according to the embodiments described above and a structure for moving the upper spreader 9' between the boom anchor and the leading end of the boom will be described with reference to FIGS. 11 to 14. On the other hand, structures common to the embodiments described above will be described with reference to the above-mentioned figures.

Along a predetermined section within between the anchor of the boom 3 and the leading end thereof, a lateral pair of rails 190 and 190 are provided on the boom upper surface.

Both the respective rails 190 and 190 are formed in a closed section having a horizontal upper surface, such as a square steel pipe.

On the other hand, the upper spreader 9' is integrally composed of a vertical sheave block 220 having a plurality of (two in the drawing) vertical sheaves 210 and 210 rotating about a horizontal sheave shaft 200 and a horizontal sheave block 250 having a plurality of (two in the drawing) horizontal sheaves 240 and 240 rotating about a vertical sheave shaft 230 with the vertical sheave block 220 directed to the front (toward the end of the boom).

By arranging the sheaves in such crossed alignment, a number of sheaves can be efficiently arranged within a small space. Accordingly, the upper spreader 9' can be miniaturized by especially reducing the width of the spreader.

It is established herein that an axis L (shown in FIG. 12) of the vertical sheave block 220 in plan view match the line passing through the vertical sheave shaft 230 of the horizontal sheave block 250 in the fore-and-aft direction (it may also match substantially and not completely).

The axis L is also a central line of the entire upper spreader 9' in plan view as well as a straight line passing through the center of gravity of the upper spreader 9' in the fore-and-aft direction in plan view. This is referred to as a spreader axis below.

Also, guyline fixing points 260 and 260 are arranged on lateral both sides of the horizontal sheave block 250 for fixing the terminal of a strut guyline 110 thereto and a tow rope fixing point 270 is provided on the front surface of the vertical sheave block 220 for fixing the terminal of a tow rope (the hook hoisting rope 17) thereto during movement of the spreader.

The tow rope fixing point 270 is provided at a position lower than that of the center of gravity arranged along the spreader axis L.

Figure 13:
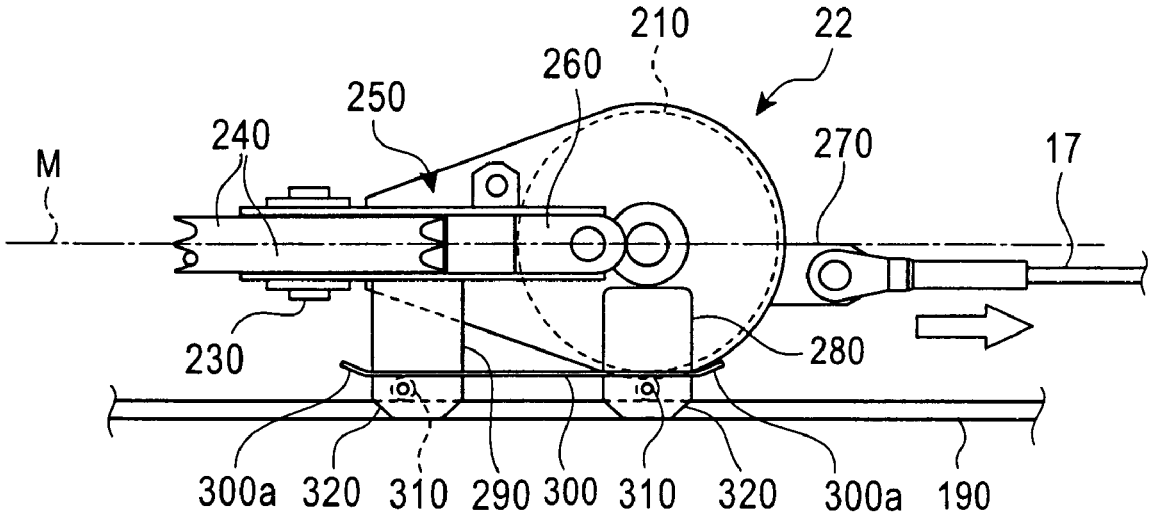
FIG. 13 is a side view of FIG. 12.

Reference character M in FIG. 13 denotes the spreader axis in side view which is also a straight line passing through the center of gravity of the spreader in side view.

In the upper spreader 9', front support legs 280 and 280 are downward protruded on lateral both sides of the vertical sheave block 220 while rear support legs 290 and 290 are downward protruded on lateral both sides of the horizontal sheave block 250. At lower ends of these support legs, a lateral pair of sled-like support plates 300 and 300 are horizontally attached astride the support legs 280 and 290 in front and in rear. In this case, the upper spreader 9' can be self-supported on the boom with pairs of the support legs arranged on either side and in front and in rear. Hence, the upper spreader 9' can be moved stably and more smoothly without inclination or stumbling.

The respective lateral support plates 300 and 300 are provided with warped portions 300*a* and 300*a* arranged at both ends in front and in rear and extending slightly upward (see FIG. 13) and rollers 310 . . . rolling on the rails 190 and 190 in the boom side and arranged on both sides and in front and in rear rotatably about the horizontal axis.

Figure 12:
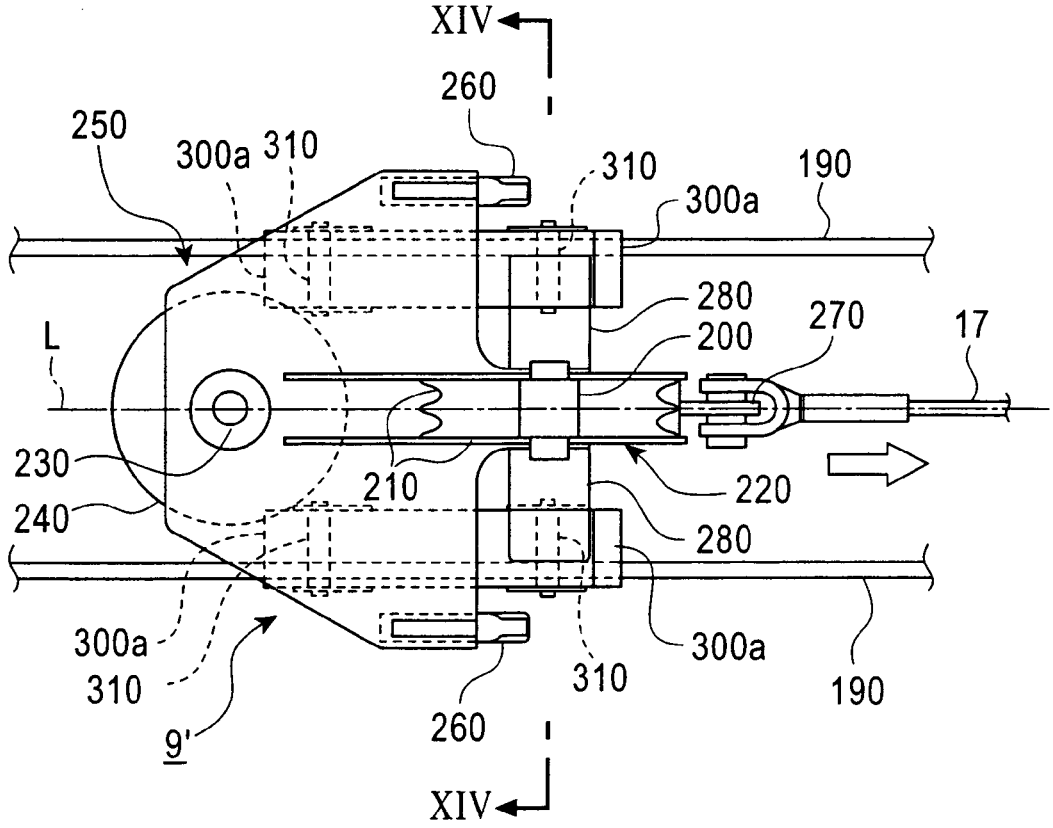
FIG. 12 is a further enlarged view of part of FIG. 11.
Figure 14:
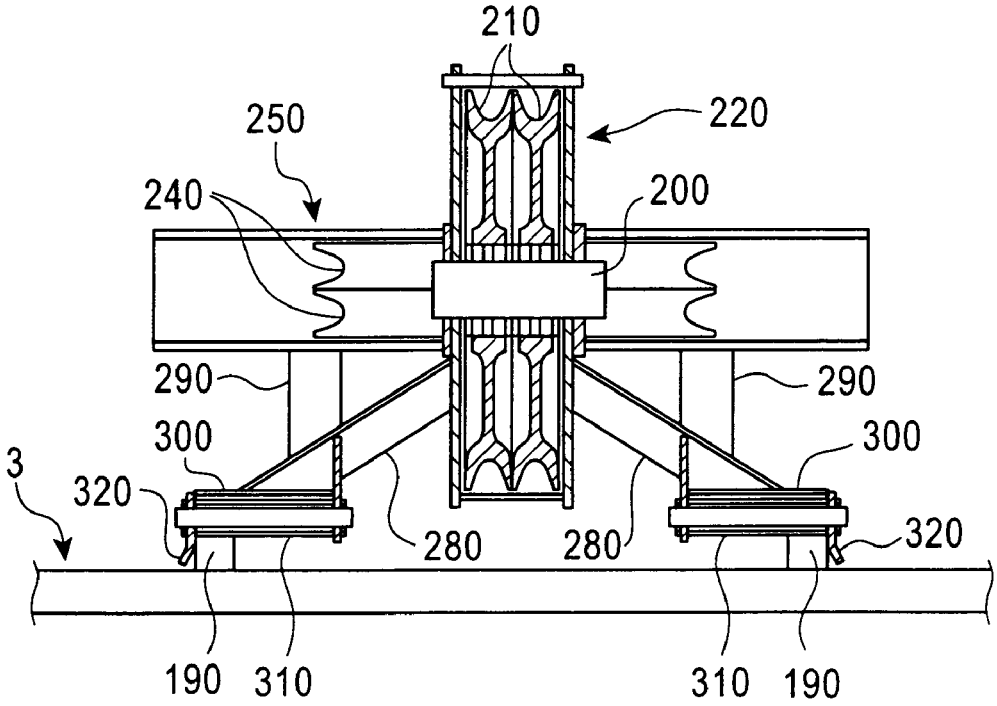
FIG. 14 is an enlarged sectional view at the line VI-VI of FIG. 12.

The respective rollers 310 . . . , as shown in FIGS. 12 and 14, are formed in a cylindrical shape with a length larger than the width of the rail so as to come in contact with the entire width of the upper surface of the respective rails 190 and 190. Since on the bottom surfaces of the support plates 300 and 300 under the support legs 280 and 290, the rollers 310 . . . are provided, the inclination in front and in rear and the stumbling of the upper spreader 9' are prevented by the support plates 300 and 300 so as to smoothly move safely.

Furthermore, on both sides and in front and in rear of the both support plates 300 and 300, roller guides 320 . . . are arranged to downward protrude for preventing the rollers 310 . . . from escaping from the rails 190 and 190.

Owing to the roller guides 320 . . . , when a lateral force is applied to the upper spreader 9', the derailment is prevented so as to move the upper spreader 9' more safely.

FIGS. 2, 5, and 11 to 14 show a state that the upper spreader is placed on the upper surface of the boom 3. At this time, the upper spreader 9' is self-supported on the boom upper surface with the support legs 290 . . . , the support plates 300 and 300, the rollers 310 . . . , and the rails 190. In this case, the upper spreader 9' can be more smoothly moved with remarkable agility with the rails 190 on the boom upper surface and the rollers 310 . . . of the support legs.

In this state, the terminal of the hook hoisting rope 17 folded back from the hook hoisting guide sheave 19, as shown in FIGS. 12 and 13, is fixed to the tow rope fixing point 270 of the upper spreader 9', and then, the jib derricking rope 7 is rewound while the hook hoisting rope 17 being wound.

Figure 15A:
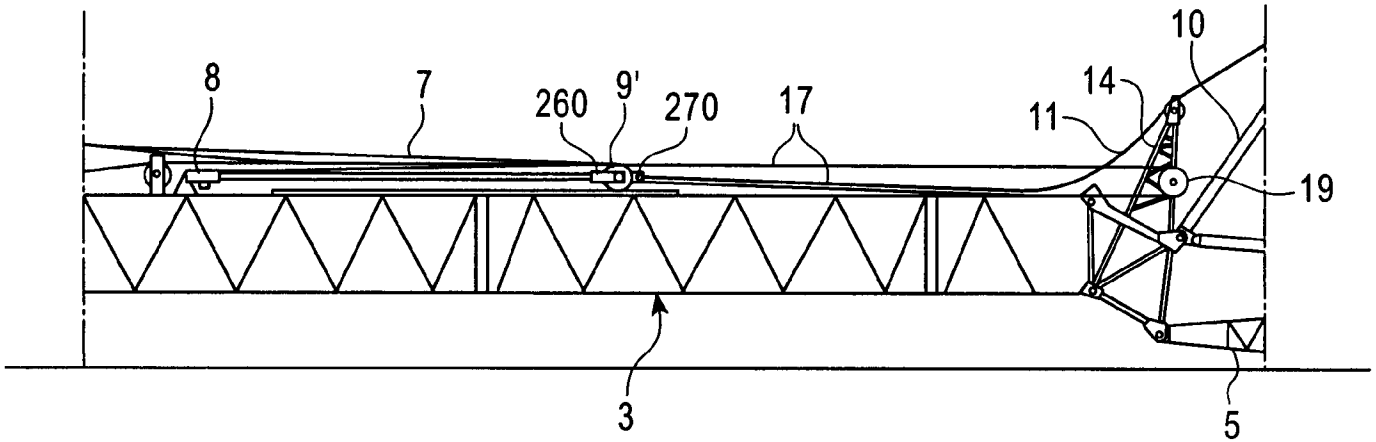
FIGS. 15A and 15B are partially enlarged views of the crane, wherein in detail

Thereby, the upper spreader 9' is moved toward the leading end of the boom 3 along the upper surface of the boom 3 while being guided by the rails 190 and 190 and the rollers 210 and 210. Then, as shown in FIGS. 5 and 15A, the upper spreader 9' is stopped to move at a position capable of connecting it to the strut guyline 11.

In this case, since both the vertical and horizontal sheave blocks 220 and 250 are arranged symmetrically with respect to the spreader axis L, the tension of the jib derricking rope 7 routed around both the vertical and horizontal sheave blocks 220 and 250 in multiple-stages can be applied substantially symmetrically with respect to the spreader axis L. Hence, the lateral inclination of the upper spreader 9' due to the rope tension imbalance can be prevented during movement of the upper spreader 9'.

Since the tow rope fixing point 270 is provided at a position lower than that of the center of gravity of the spreader along the spreader axis L, the following effects can be obtained:

l) the rope pulling force can be applied to the center of gravity of the spreader, so that the lateral inclination during the movement of the spreader can be prevented; and ll) since the pulling force is applied to a position lower than that of the center of gravity of the spreader, the back and forth inclination can also be prevented so as to move the upper spreader 9' in a horizontal posture.

Furthermore, the rail 190 is formed in a closed square section, so that the roller 310 comes in contact with the entire width of the upper surface of the rail 190. Hence, the upper spreader 9' can be slid while being stably supported. Moreover, since the rail 190 itself has a closed sectional shape, the entire structure becomes highly rigid and strong, resulting in having the stable guiding function for a long period of time.

Figure 15B:
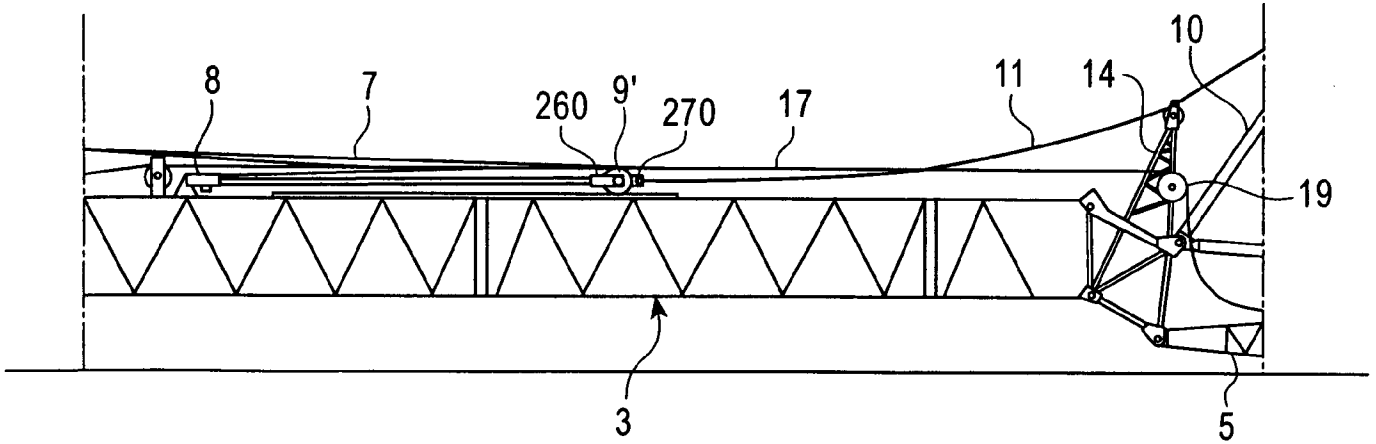

Thereafter, as shown in FIG. 15B, the hook hoisting rope 17 is removed from the tow rope fixing point 270 of the upper spreader 9', and instead the strut guyline 11 is connected to the guyline fixing points 260 and 260. Along with this operation, the hook hoisting rope 17 is established in an operation mode; then, as shown in FIG. 7, the boom 3 and the jib 5 are raised to have an operation mode shown in FIG. 1.

In this case, in a state that the tension of the strut guyline 11 is increased larger than the self-weight component of the upper spreader 9', the upper spreader 9' is separated from the rails 190 and 190 (upper surface of the boom).

In addition, the horizontal movement operation of the upper spreader 9' may also be used for the self-assembling of the strut 10, i.e., the operation for unfolding the folded strut 10 at the end of the boom. In this case, by moving the upper spreader 9' from the far end of the boom toward the boom anchor, the strut guyline 11 is drawn so as to open the upper spreader 9' enabling the self-assembling of the strut 10 to be safely and efficiently performed.

During disassembling of the crane, the operation is performed in the reverse order to that during assembling described above.

In such a manner, the upper spreader 9' can be horizontally moved in a floated state from the boom upper surface with the support legs 280 and 290, the support plates 300 and 300, the rollers 310 . . . , and the rails 190 and 190 (these will be referred to as support legs and the like below). Accordingly, the interference between the upper spreader 9' and obstacles on the boom upper surface does not occur during spreader movement.

In this case, the support legs and the like may be partially provided in the upper spreader 9' and on the boom upper surface, and the positions of these may be selected as those capable of avoiding the obstacles, so that the interference between the obstacles and the support legs and the like can be readily avoided.

Accordingly, the interference problem to the obstacles can be solved during spreader movement. Hence, the upper spreader 9' can be smoothly moved from the boom anchor toward the far end of the boom while damages of the upper spreader 9' and the obstacles due to the interference can be prevented.

Moreover, the upper spreader 9' can be stably moved in remarkable agility with the minimal frictional resistance by the rollers 310 . . . and the rails 190 and 190 in a state that the upper spreader 9' is self-supported on the boom 3 by the support legs and the like.

Furthermore, the respective support plates 300 and 300 are provided with the warped portions 300*a* and 300*a* arranged at both ends in front and in rear and extending slightly upward. Hence, even if the upper spreader 9' is accidentally inclined in front and in rear, the smooth movement can be secured with the warped portions 300*a* and 300*a*.

During disassembling the crane, even if the upper spreader 9' is inclined in front and in rear when the upper spreader 9' descends on the boom upper surface, the upper spreader 9' can be brought into smooth contact with the boom upper surface by the warped portions 300*a* and 300*a*, preventing the damage of the boom upper surface.

On the other hand, according to the embodiment, the hook hoisting guide sheave 19, which is originally provided at the boom top as part of the hook hoisting device, is also used as a guide sheave for guiding the hook hoisting rope 17 to the upper spreader 9' during assembling/disassembling the crane. Thus, although the technique to move the upper spreader 9' between the boom anchor and the far end of the boom is employed, it is not required to separately have a guide sheave, which is dedicated for moving the upper spreader, at the top of the boom.

Thereby, a traveling crane (tower crane) capable of self-assembling without increasing the weight of a boom end portion can be provided.

(1) According to the embodiment described above, a case is exemplified in that the hook hoisting rope 17 is used as a pulling rope for pulling the upper spreader 9'; alternatively, an auxiliary rope of a dedicated auxiliary winch provided separately may be used therefor; the pulling force of another crane may also be used.

(2) According to the embodiment described above, the support plates 300 and 300 are provided at the lower ends of the support legs 280 and 290, and the rollers 310 . . . are provided in the support plates 300 and 300; alternatively, the rollers 310 . . . may be directly provided at the lower ends of the support legs 280 and 290 by eliminating the support plates 300 and 300.

(3) According to the embodiment described above, the rails 190 and 190 are provided on lateral both sides of the upper surface of the boom; alternatively, only one rail 190 may be provided at the center as long as the stable movement of the upper spreader 9' is obtained. In this case, the support legs 280 and 290 in the spreader side are arranged also on both sides at the center of the spreader in a fore-and-aft direction, respectively.

Alternatively, the support legs of the upper spreader 9' may be arranged only on both sides at the center, and both the support legs may be moved along the lateral rails 190 and 190.

(4) The rail 190 is not limited to a square section exemplified in the embodiment described above, so that a triangular section, a semicircular section, or a trapezoidal form may be employed and a roller having a structure corresponding to the rail sectional shape may be used.

(5) As a support leg guide member, instead of the rail 190, a slide guide plate made of a slippery material may be provided on the upper surface of the boom. In this case, the rollers 310 . . . of the support legs may be directly rolled on the slide guide plate, or a guide groove is provided in the slide guide plate, and the rollers 310 . . . may be rolled with the guide groove.

(6) As means for pulling the upper spreader 9', instead of the winch mounted on the base machine, a winch fixed on or detachably fixed on the upper surface of the boom may be provided, so that a rope drawn from this winch along the inside or the bottom surface of the boom may be led from the boom anchor toward the far end of the boom so as to pull the upper spreader 9'. In addition, in order to take a synergic effect, a plurality of embodiments described above may be obviously combined.

Although the invention has been described with reference to the preferred embodiments in the attached figures, it is noted that equivalents may be employed and substitutions made herein without departing from the scope of the invention as recited in the claims.

What is claimed is:

1. A traveling crane comprising: a base machine having a boom derrickably attached thereto at one end of the boom and a jib derrickably attached to the other end of the boom; and a jib derricking device for raising and lowering the jib, the jib derricking device comprising: a jib derricking winch for derricking the jib; a jib derricking rope wound/rewound by the jib derricking winch; lower and upper spreaders around which the jib derricking rope is routed for raising and lowering the jib; a strut attached to the top of the boom rotatably about a horizontal axis in a fore-and-aft direction; a jib guyline connecting the strut to the jib; and a strut guyline connecting the strut to the upper spreader, wherein during assembling/disassembling of the crane, the upper spreader is constructed to move along the upper surface of the boom between a position adjacent to a boom anchor and a position, at which the strut guyline is fixed and unfixed, adjacent to a far end of the boom, and wherein the upper spreader is provided with support legs arranged to protrude downwardly for supporting the spreader on the boom with support leg guide members arranged on the upper surface of the boom for guiding the support legs.

2. The crane according to claim 1, wherein pairs of the support legs are provided on both sides and in front and in rear of the upper spreader, so that the upper spreader is self supported on the upper surface of the boom with the support legs.

3. The crane according to claim 1, wherein the support leg guide members are each composed of a rail arranged on the upper surface of the boom and a roller disposed at the lower end of the support leg for rolling on the rail.

4. The crane according to claim 3, wherein the rail is formed as a solid section having a substantial horizontal upper surface in a state that the boom is held in a substantial horizontal position, and the roller comes in contact with the upper surface of the rail along the entire width of the upper surface.

5. The crane according to claim 3, wherein the support legs each comprise roller guide for preventing the roller from escaping from the rail.

6. The crane according to claim 3, wherein the support legs have sled-like support plate disposed at the lower end of the support leg and extending in front and in rear, the support plate having the roller disposed on its bottom surface.

7. The crane according to claim 6, wherein the support plate comprises warped portions disposed on both ends in front and in rear and extending slightly upward.

8. The crane according to claim 1, wherein the upper spreader comprises a tow rope fixing point provided at the end of the upper spreader adjacent to the far end of the boom along a fore-and-aft straight line passing through the center of gravity of the upper spreader or the vicinity thereof for fixing a rope thereto for pulling the spreader from the boom anchor toward the far end of the boom.

9. The crane according to claim 8, wherein the tow rope fixing point is arranged at a position lower than that of the center of gravity of the upper spreader.

10. The crane according to claim 1, wherein the upper spreader comprises a vertical sheave block, disposed on one side of the upper spreader in a fore-and-aft direction, having a plurality of vertical sheaves rotating about a horizontal sheave shaft; and a horizontal sheave block, disposed on the other side, having a plurality of horizontal sheaves rotating about a vertical sheave shaft.

11. The crane according to claim 10, wherein the axis of the vertical sheave block in plan view is substantially aligned with a straight line in a fore-and-aft direction passing through the center of the sheave shaft of the horizontal sheave block.

* * * * *